United States Patent [19]

Murdoch

[11] Patent Number: 5,020,827

[45] Date of Patent: Jun. 4, 1991

[54] SKATEBOARD BRIDLE

[76] Inventor: Rashirl J. Murdoch, 520 W. 7th St., Chico, Calif. 95926

[21] Appl. No.: 573,902

[22] Filed: Aug. 27, 1990

[51] Int. Cl.[5] ..... A63C 7/14

[52] U.S. Cl. ..... 280/816; 16/115; 16/126; 280/87.042; 441/75

[58] Field of Search ..... 441/65, 74, 75; 280/809, 816, 655, 87.042, 47.371; 16/115, 125, 126

[56] References Cited

U.S. PATENT DOCUMENTS

| | | | |
|---|---|---|---|
| 1,213,454 | 1/1917 | Brown | 280/87.042 |
| 2,009,192 | 7/1935 | Freysinger | 16/115 X |
| 3,198,300 | 8/1965 | Tuttle | 16/115 |
| 3,566,436 | 3/1971 | Marks et al. | 16/115 |
| 4,129,313 | 12/1978 | Benson | 280/14.2 |
| 4,887,825 | 12/1989 | Allen et al. | 280/809 X |

*Primary Examiner*—Andres Kashnikow
*Assistant Examiner*—Michael Mar

[57] ABSTRACT

An elastic bridle attachable to a skateboard assumes a normally snapped-down, retracted position closely adjacent the top stand-on surface of the skateboard platform. The bridle is grasped and pulled upward for use during jumping. When released, the bridle snaps back to the retracted position against the skateboard stand-on platform surface.

3 Claims, 5 Drawing Sheets

SKATEBOARD BRIDLE

BACKGROUND OF THE INVENTION

1. Field of the Invention

This invention relates generally to skateboard equipment. The present invention is a flexible bridle particularly directed towards stabilizing rider contact with a skateboard during jumps and other difficult maneuvers. The bridle is elastic and is attachable to the sides of a skateboard platform in a manner to assume a retracted position closely adjacent the skateboard top surface when not in use. The bridle can be pulled up and stretched for use. By holding the bridle while jumping, a skateboarder can keep his feet firmly positioned against the skateboard platform without gripping the edges of the skateboard platform.

2. Description of the Prior Art

Although many types of bridle-like control cords are seen on various pieces of snow and water related sporting devices, bridles for maintaining rider contact with a skateboard are not readily available. With skateboards now being used for both fun and serious sports, a bridle useful for better maintenance of the rider's feet in contact with a free skateboard could both increase the experienced rider'skill and be a safety factor for the novice.

The control a rider has over a skateboard normally depends on the rider's balancing ability and alertness in shifting his weight. Frictional contact with the skateboard platform using gravity is the rider's principal adherent. Novice riders frequently find this inadequate and take spills. Evan professional riders often lose foot contact with the skateboard platform, sometimes with serious results. The skilled rider must grasp the board by an end or a side when making a jump or a difficult turn. Many riders become very proficient at this but the novice often slides off the skateboard during the simplest of maneuvers. The attachable bridle according to the present invention would overcome board surface contact difficulties incurred by the professional skateboarder and would provide a safety factor for the novice.

SUMMARY OF THE INVENTION

Therefore, in practicing my invention, I provide a skateboard bridle that can be attached to the sides of a skateboard platform. The bridle is readily accessible for use and snaps to a retracted position flat on the top surface of a skateboard when not in use. The bridle according to the invention is a flexible cable. The cable is elastic and has two terminal ends. Fixtures are provided for attaching both terminal ends of the bridle to the sides of a skateboard. One fixture includes brackets with V centers and flat ends. The flat ends are apertured. Screws fitting the aperatures attach the brackets to the sides of the skateboard. The brackets are sufficiently flattened to hold the bridle ends tightly against the skateboard sides. A knot below the bracket prevents the bridle from being pulled up through the bracket during use. When not in use, the elastic bridle snaps down flat on the surface of the skateboard. For use, the skateboarder reaches down and pulls on the bridle. The elastic material from which the bridle is constructed allows the bridle to be stretched out to a useful length. During jumps, a professional skateboarder can keep the skateboard platform firmly against his feet without reaching down and holding onto the skateboard. A novice can maintain his position on the skateboard while practicing jumps. When released, the elastic bridle of this invention snaps back to a flat position on the skateboard surface. For the bridle material, a "Bungee" type cable works well as does reinforced, especially structured surgical tubing. A more complicated embodiment would include tubular housing at one or both terminal ends of the bridle. The bridle would retract and be stored inside the tubular housing under or along the sides of a skateboard. A simple mechanical retractor would include spring biased rods along the sides of the skateboard platform. The elastic bridle would be attached to the free ends of the rods across the skateboard platform. In use, the rods would be pulled to a vertical position. When the bridle is released, the rods would snap down into brackets on the sides of the skateboard platform with the bridle flattened across the top skateboard platform surface.

Therefore, a principal object of the present invention is to provide a retractable bridle useful for maintaining foot contact with a skateboard during jumping.

Another object of the invention is to provide a bridle for a skateboard which can be readily attached to and removed from the skateboard.

A further object of this invention is to provide a skateboard bridle which will remain out of the way in a flattened position on a skateboard top surface until pulled up for use and will return to the original flattened position when released.

Other objects and the many advantages of the present invention will become clear from reading the specification and comparing numerically designated parts described relative to the same numbered parts illustrated in the drawings.

DESCRIPTION OF THE PREFERRED EMBODIMENTS

Figure 1:
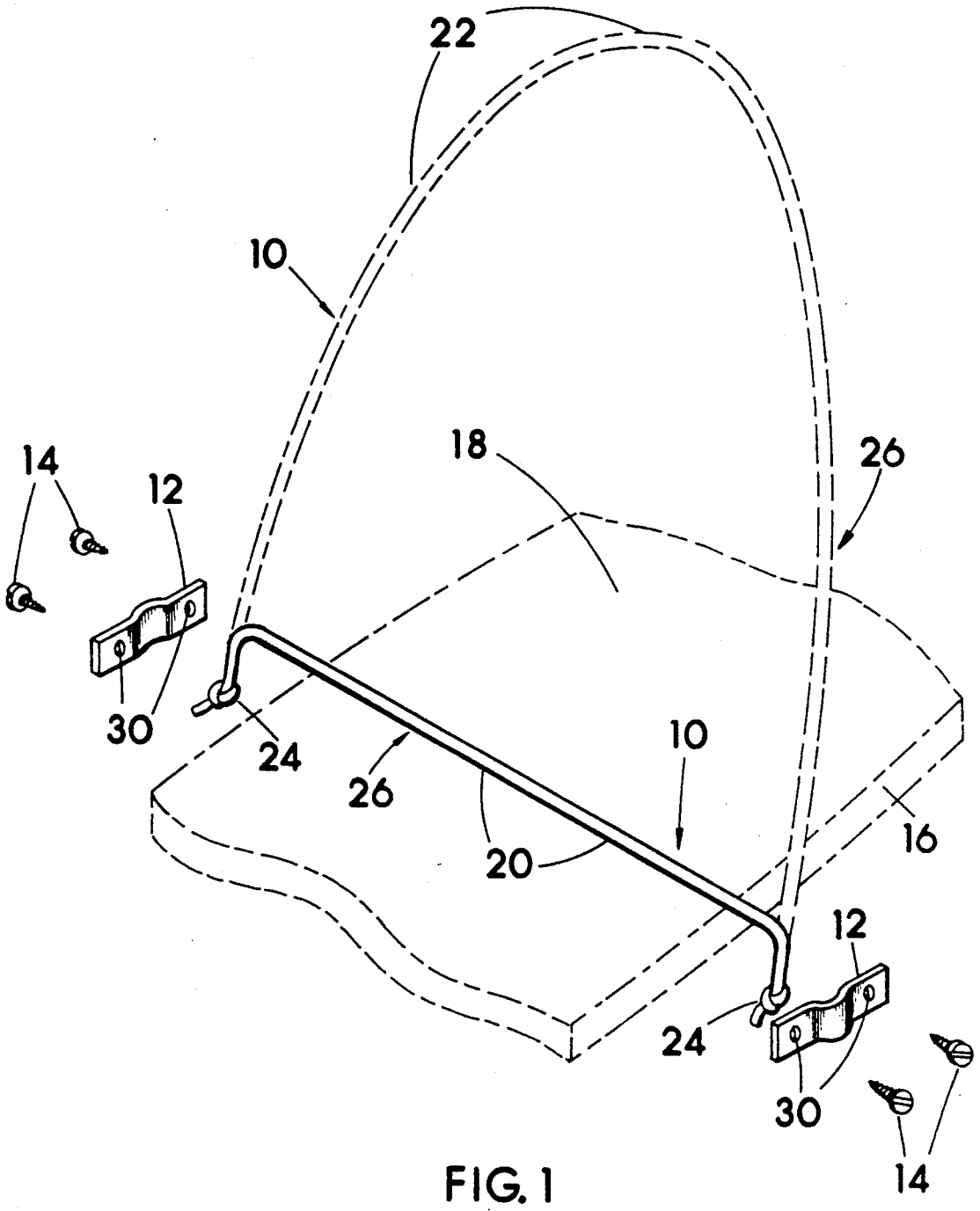
FIG. 1 shows the elastic bridle according to the invention ready for attachment to a skateboard platform. The position of the retracted bridle is illustrated in solid lines. The stretched bridle for use is shown in dotted lines.

Referring now to the drawings at FIG. 1 where bridle 10, according to the invention, is illustrated ready for attachment to skateboard 16. Bridle 10 is structured of elastic material 26. In FIG. 1, bridle 10 is shown by solid lines in bridle retracted position 20 flat against the top side of skateboard platform 18 and by dotted lines in bridle stretched position 22. For attachment of bridle 10 to skateboard 16, bridle brackets 12 with attachment apertures 30 at each end are shown positioned ready to be fastened to skateboard 16 by bracket screws 14. A knot 24, one at each end of bridle 10, prevents bridle 10 from slipping through bridle brackets 12. Bracket screws 14 press bridle brackets 12 against the elastic material 26 holding bridle 10 firmly against the sides of skateboard 16.

Figure 2:
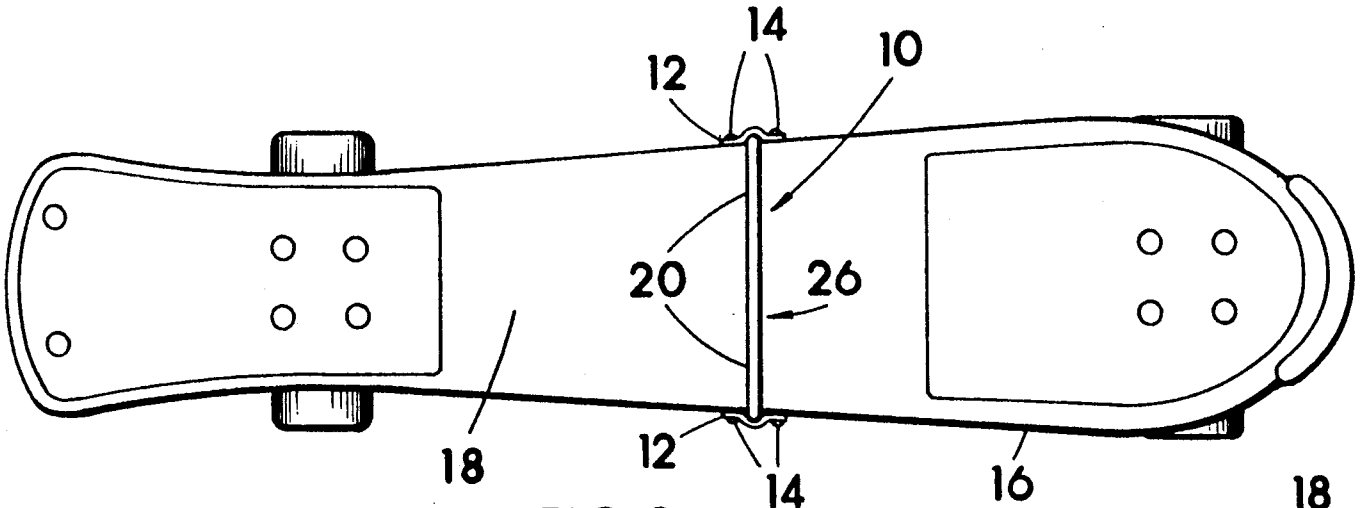
FIG. 2 is a top plan view of a skateboard with the present invention attached and in a retracted or snapped-down position.
Figure 3:
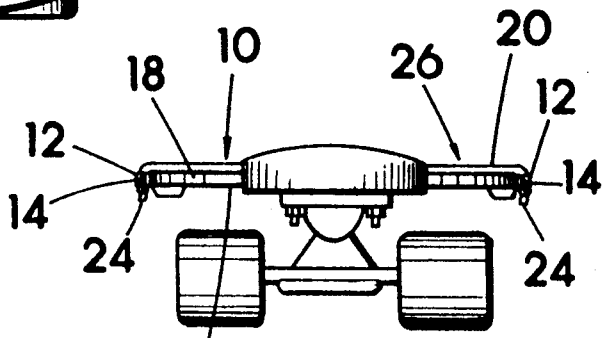
FIG. 3 is a side view of the skateboard of FIG. 1 showing the invention attached and illustrating the position of the attachment brackets.
Figure 4:
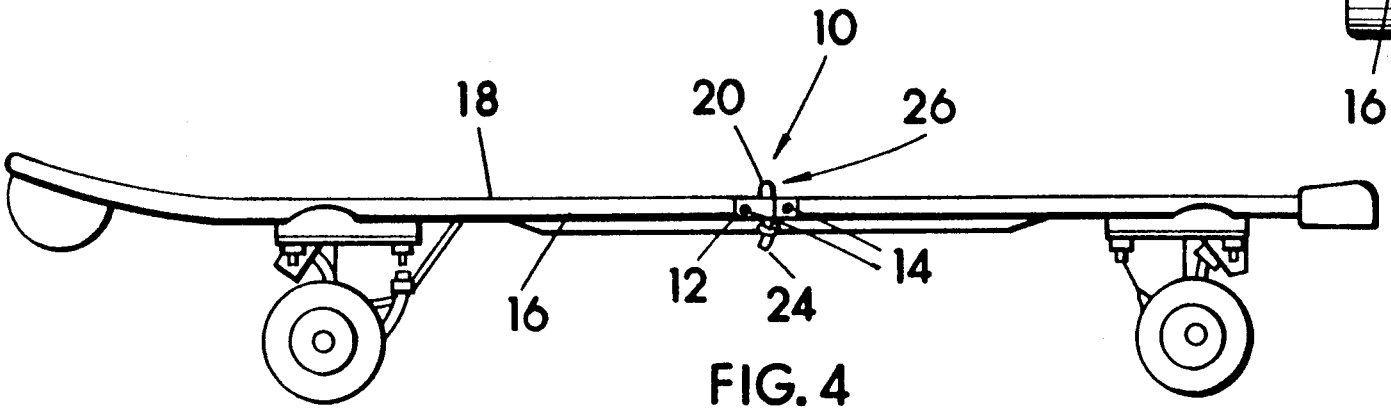
FIG. 4 shows the skateboard in a frontal view with the invention attached and in a retracted position.
Figure 5:
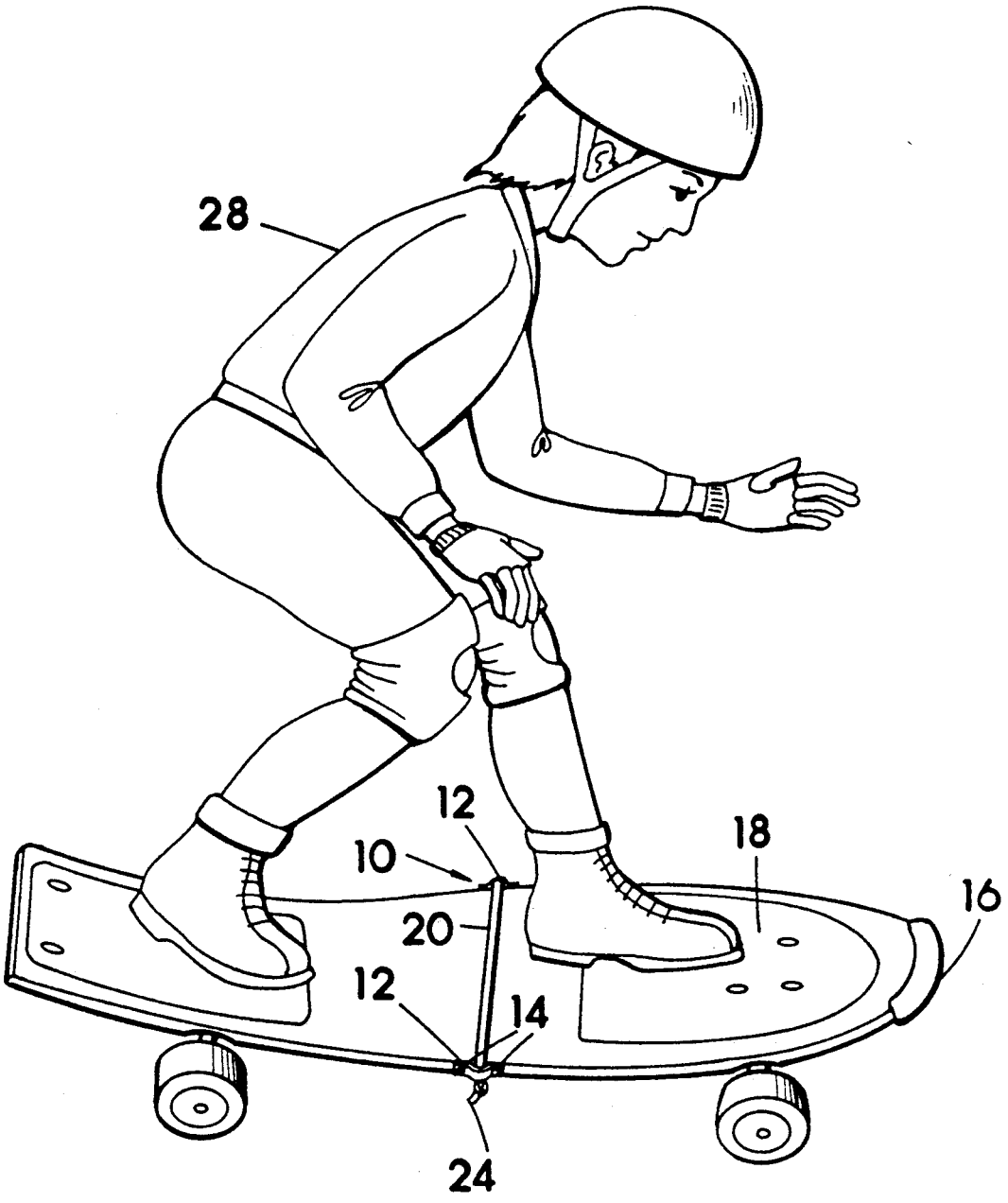
FIG. 5 shows a skateboarder riding along on a skateboard in a non-jumping position. The bridle according to the invention is retracted flat against the skateboard surface while not being used.
Figure 6:
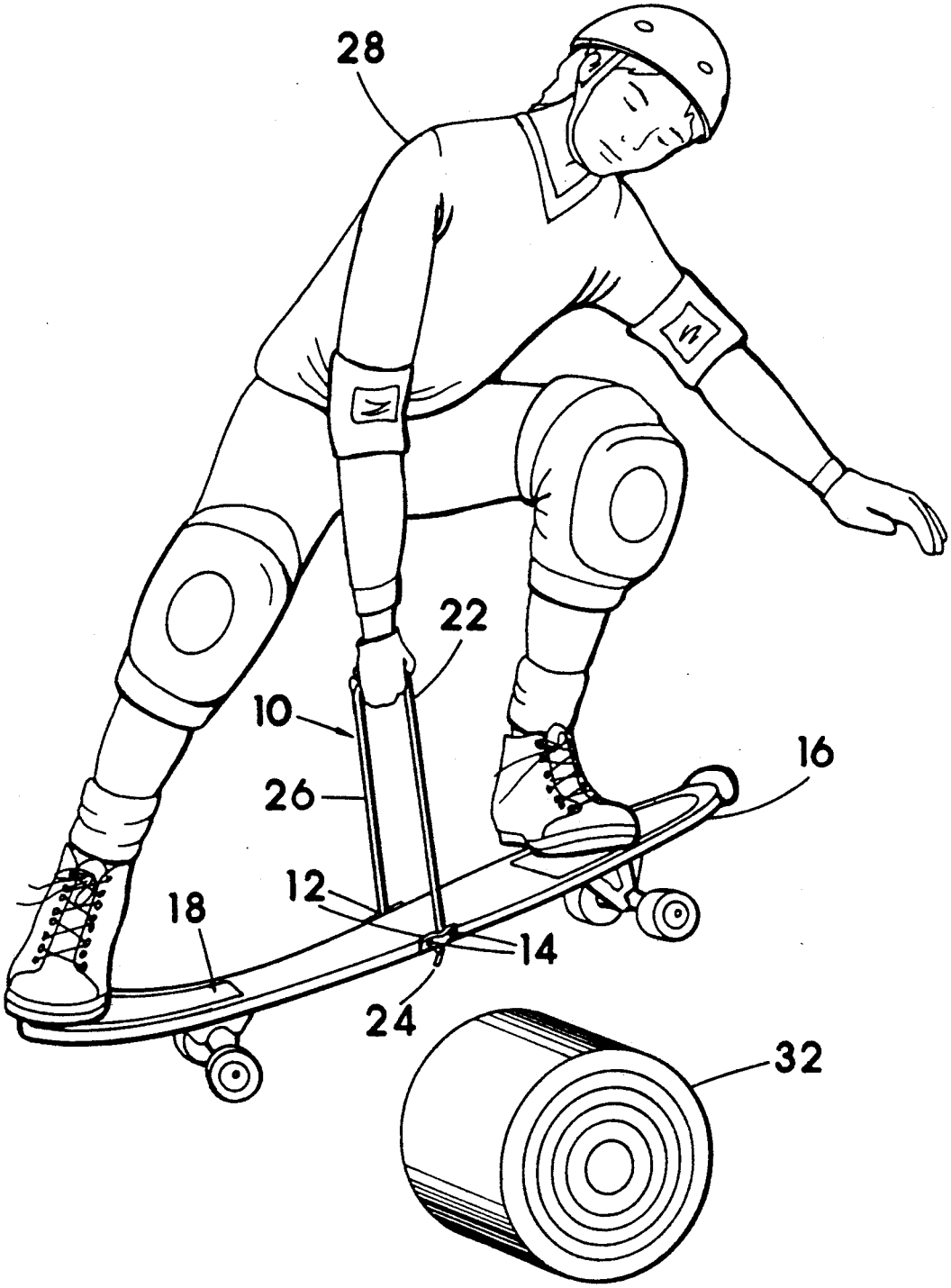
FIG. 6 shows a skateboarder jumping a skateboard over a barrel while using the bridle of the present invention to maintain his feet firmly positioned on the skateboard surface.

In FIGS. 2, 3 and 4, the attachment of bridle 10 to skateboard 16 by bridle brackets 12 is illustrated in a top plan view, a side view, and a frontal view. These three views show the retracted position 20 of bridle 10 when not in use snapped down flat against the upper surface of skateboard platform 18. Skateboard 16 can be used with bridle 10 in the bridle retracted position 20 as is illustrated in FIG. 5. A skateboarder 28 is shown jumping skateboard 16 over a barrel 32 in FIG. 6. For this purpose, bridle 10 is pulled to stretched position 22. By using bridle 10 in the illustrated manner, skateboarder 28 can make jumps without gripping and holding onto the side or the end of his skateboard 10 and can still maintain his footing on skateboard platform 18.

Figure 7:
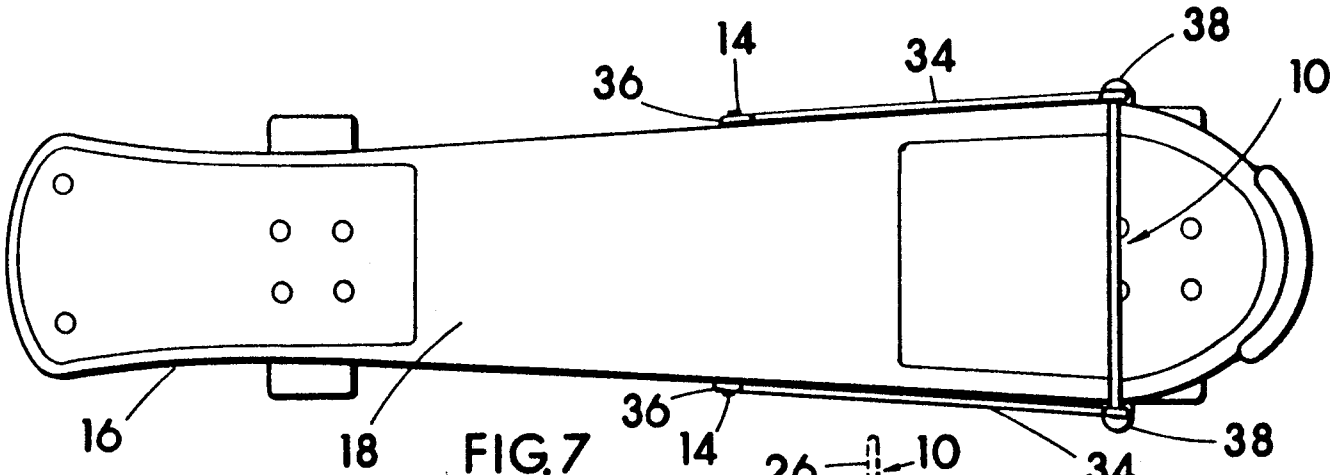
FIG. 7 is a top plan view of a skateboard with the bridle according to the invention attached by spring biased rods to the sides of the skateboard. The bridle is shown in retracted position flattened across the top platform surface of the skateboard.
Figure 8:
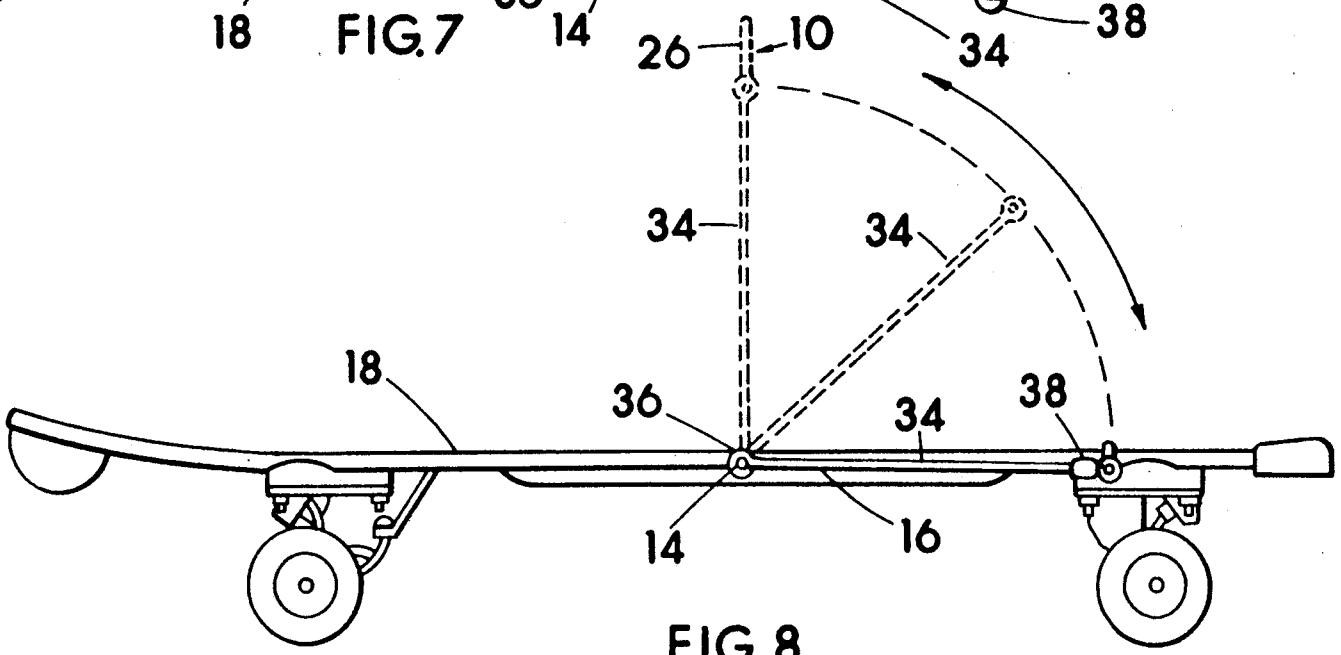
FIG. 8 is a side view of a skateboard with the bridle affixed to spring biased rods. Movement of the rods and bridle are illustrated from a retracted position to a use position and back to a retracted position.

An appliance, spring rod 34, shown in FIGS. 7 and 8, with a shortened elastic bridle 10 attached across free ends is an attachment device which can be used alternately in place of bridle brackets 12. Spring rod 34 is biased by coil spring 36 to maintain a bridle retracted position 20 with spring rods 34 paralleling skateboard platform 18. Spring rods 34 retracted rest the ends attached to bridle 10 in rod rests 38. To use bridle 10, spring rods 34 can be pulled upward as shown in FIG. 8. When bridle 10 is released, spring rods 34 pressured by coil spring 36 return to the bridle retracted position 20 along the sides of skateboard platform 18. In retracted position 20, spring rods 34 rest in rod rests 38.

Although I have described embodiments of my invention with considerable detail in the foregoing specification and have illustrated them extensively in the drawings, it is to be understood that I may practice variations in the invention which do not exceed the scope of the appended claims. Also, any variations of my invention practiced by others which fall within the scope of my claims, I shall consider to be my invention.

What is claimed is:

1. A skateboard bridle for attachment to a skateboard having a planar surface and a pair of longitudinally extending sides, comprising:

(a) a pair of elongated rods, each rod having a first end and a second end;

(b) attachment means for pivotally attaching the first end of each rod to a respective side of said skateboard for pivotal movement about a common transverse axis between an operative position, with said rods extending vertically above said skateboard and a retracted position, with each of said rods extending parallel to a respective side of said skateboard;

(c) spring means for biasing each of said elongated rods to said retracted position;

(d) a one-piece cord made of elastic material and having two terminal ends; and (e) means for attaching each of said terminal ends of said cord to the second end of a respective rod, wherein said cord extends in a straight manner between said rods when the rods are in a retracted position and said cord is capable of being stretched to assume an inverted U-shaped configuration while being grasped and pulled by a standing skateboard rider, when the rods are in an operative position.

2. The skateboard bridle of claim 1 wherein said attachment means includes removable fastener means.

3. The skateboard bridle of claim 2 wherein said removable fastener means includes screws.

* * * * *